US006911085B2

(12) United States Patent
Knop

(10) Patent No.: US 6,911,085 B2
(45) Date of Patent: Jun. 28, 2005

(54) DOCTOR BLADE DOSING SYSTEM

(75) Inventor: Reinhard Knop, Essen (DE)

(73) Assignee: Horst Sprenger GmbH, Moers (DE)

( * ) Notice: Subject to any disclaimer, the term of this patent is extended or adjusted under 35 U.S.C. 154(b) by 0 days.

(21) Appl. No.: 10/489,271

(22) PCT Filed: Mar. 7, 2003

(86) PCT No.: PCT/DE03/00738

§ 371 (c)(1),
(2), (4) Date: Oct. 15, 2004

(87) PCT Pub. No.: WO03/078077

PCT Pub. Date: Sep. 25, 2003

(65) Prior Publication Data

US 2005/0039676 A1 Feb. 24, 2005

(30) Foreign Application Priority Data

Mar. 13, 2002 (DE) ..... 102 11 302

(51) Int. Cl.[7] ..... B05C 11/02

(52) U.S. Cl. ..... 118/110; 118/119; 118/126; 118/262; 118/414; 101/123; 101/124; 162/281

(58) Field of Search ..... 118/110, 118, 118/119, 123, 126, 262, 413, 414; 101/123, 124; 162/281; 15/256.5–256.52; 427/355, 356

(56) References Cited

U.S. PATENT DOCUMENTS 4,367,691 A 1/1983 Bergs ..... 118/119

FOREIGN PATENT DOCUMENTS

| | | | |
|---|---|---|---|
| DE | 30 22 955 A1 | | 12/1981 |
| DE | 19602483 | * | 6/1997 |
| DE | 100 45 515 A1 | | 4/2002 |
| WO | WO 00/63494 | | 10/1999 |

* cited by examiner

*Primary Examiner*—Laura Edwards
(74) *Attorney, Agent, or Firm*—Marshall, Gerstein & Borun LLP

(57) ABSTRACT

Doctor blade dosing systems for devices used for coating material webs, particularly paper or paperboard webs, exist that have a doctor blade rod, which serves as a dosing element while being held inside a slot of a doctor blade bed that, in turn, is mounted in a support that can be fastened inside the frame of the system. According to the disclosure, the doctor blade rod has a diameter of less than 25 mm. The doctor blade bed is inserted in removable manner into a slot of the support situated on the face thereof. The ratio of the cross-sectional area (measured in $mm^2$) of the doctor blade to the diameter (measured in mm) of the doctor blade rod is less than 60 mm, preferably less than 30 mm. The support is made of a plastic material and is shaped like a clamp having at least one rearward extending clamp limb and one joint location, whereby the holding slot that accommodates the doctor blade bed forms the clamp mouth. A tightening tube that presses the slot walls of the holding slot toward one another is placed on a clamp limb.

18 Claims, 2 Drawing Sheets

DOCTOR BLADE DOSING SYSTEM

This is the U.S. national phase of International Application No. PCT/DE03/00738 filed Mar. 7, 2003, the entire disclosure of which is incorporated herein by reference.

BACKGROUND OF THE INVENTION

1. Field of the Disclosure

The disclosure relates to a doctor blade dosing system for a device used for coating material webs, particularly paper or paperboard, that has a doctor blade rod which serves as a dosing element while being held inside a slot of doctor blade bed that is mounted in a support that can be fastened inside the frame of the system.

2. Related Technology

It is a known procedure to coat continuous paper or paperboard webs by means of devices that have an application system for applying an excess of liquid coating material and a downstream dosing system fitted with a doctor blade rod as the dosing element that scrapes off the excess coating material until the desired application weight is achieved. The application and dosing procedures take place either directly onto the web or indirectly, first of all onto a roller that deflects the web and subsequently transfers the dosed film of coating material onto the web.

A doctor blade dosing system of the generic type is described in DE-A 3022955. The doctor blade rod is held in a doctor blade bed made of rubber-elastic material that is mounted in a support that is connected to the machine frame. At its rear side facing away from the doctor blade rod, the doctor blade bed is supported by a pressure tube so that the thickness of the dosed film on the roller or on the web can be varied to a certain extent by means of the pressure in the pressure tube. In the doctor blade bed, there are two open rinsing channels that run parallel to the doctor blade and that are open towards the doctor blade rod, into which a rinsing liquid, for example, water can be fed in order to lubricate the bearings of the doctor blade rod and to remove coating material that has penetrated there. Such doctor blade dosing systems in which the doctor blade bed is supported by a pressure tube are called roll doctor systems. They are used for direct dosing onto the web in an area where they are supported by a mating roll. So-called revolving doctor systems are likewise known in which the web is conveyed around the doctor blade in a free-running area. With these systems, the doctor blade bed is secured in a rigid holder without a pressure hose.

The doctor blade rods are normally made of steel and have a diameter between 6 mm and 40 mm. Since the pigment coatings normally used as the coating material for coating paper or paperboard are highly abrasive, it is a known procedure to coat the surface of the doctor blade rods with wear-resistant materials in order to increase the wear-resistance. Depending on the application purpose, doctor blade rods having a smooth lateral curved surface or doctor blade rods with circumferential grooves are used. During the operation of doctor blades with a smooth lateral curved surface, a narrow gap exists relative to the web to be coated so that the desired amount of coating material passes through this gap. Doctor blades with circumferential grooves are in contact with the web or roll during the dosing. The application weight that remains is determined primarily by the groove cross section through which the coating material can pass.

In order to hold the doctor blade rod securely in the slot, the known doctor blade beds have to be manufactured with precise dimensions. Since the doctor blade beds have a relatively large cross section, they are manufactured in a casting process in order to achieve the necessary dimensional accuracy and/or the required dimensional accuracy is attained by means of metal-cutting. The production is material-intensive and labor-intensive.

The doctor blade rod, which rotates during operation, causes considerable wear and tear to the doctor blade bed. Consequently, the material-intensive and labor-intensive doctor blade beds have to be replaced at regular intervals. Such replacement entails considerable costs. In order to reduce the replacement costs due to wear and tear without impairing the quality of the coating, the roll doctor system according to German Patent Application No. 10045515 has a support with a slot into which the doctor blade bed can be placed with the inserted doctor blade rod. The doctor blade bed is configured as the smallest possible wearing part.

SUMMARY OF THE DISCLOSURE

Therefore, the disclosure is based on the objective of improving a doctor blade dosing system according to German Patent Application No. 10045515 in such a way that the doctor blade bed with the inserted doctor blade rod can be replaced in a simple manner.

This objective is achieved according to the disclosure in that

- the doctor blade rod has a diameter of less than 25 mm,
- the doctor blade bed is inserted in a removable manner into a slot on the front of the support, whereby the ratio of the cross-sectional area (measured in $mm^2$) of the doctor blade bed to the diameter (measured in mm) of the doctor blade rod is less than 60 mm, preferably less than 30 mm,
- the support is made of a plastic material and is shaped like a clamp having at least one rearward extending clamp limb and one joint, whereby the holding slot that accommodates the doctor blade bed forms the clamp jaw, and
- a clamping tube that presses the slot walls of the holding slot toward one another is arranged on a clamp limb.

According to the disclosure, the doctor blade bed is configured as the smallest possible wearing part, as a result of which it requires less material than the prior-art doctor blade beds. The fact that less material is required also allows the use of higher-quality-that is to say, more expensive-materials that translate into a longer service life for coating purposes. The support is not a wearing part. Therefore, it can be produced in a more complex manner, for example, by metal-cutting methods. It can be configured in such a way that it can be used universally and can accommodate different doctor blade beds for doctor blade rods having different diameters. Furthermore, the division of the support system for the doctor blade rod into two parts, namely, the doctor blade bed and the support, allows the use of various combinations of materials in order to improve the operational behavior of the dosing system. Thus, for instance, the doctor blade bed can be made to be especially elastic for an improved sealing behavior with respect to the doctor blade rod and particularly wear-resistant, while the support is made of a harder material so that its greater stiffness prevents vibrations in the dosing system.

The shaping of the support like a clamp with a pressure tube that presses against a clamp limb and thus presses the slot walls of the holding slot toward one another makes it possible to relax the support slot by lowering the pressure in the clamping tube in order to change the doctor blade bed.

During the operation of the dosing system, the clamping tube is under pressure so as to securely hold the doctor blade bed with the inserted doctor blade rod.

The configuration of the dosing system according to the disclosure has the additional advantage that the tension with which the doctor blade rod is held in the doctor blade bed can be regulated via the pressure in the clamping tube. The friction of the doctor blade rod is a function of the tension during the rotation of the doctor blade rod in the doctor blade bed and said friction can thus be set at the lowest possible values. Thus, in the case of very wide (>10 meters) coating installations, doctor blade rods with small diameters (10 mm to 12 mm) can be used whose ends are driven without the torsional forces becoming excessive. Moreover, detrimental vibrations of the doctor blade rod during operation can be avoided by changing the damping effect of the system via the pressure in the clamping tube. With the clamping tube, the system advantageously has an additional control element with which the operational behavior can be positively influenced with the tube pressure serving as the regulated quantity.

BRIEF DESCRIPTION OF THE DRAWINGS

The drawings serve to explain the disclosed apparatus on the basis of embodiments depicted in a simplified form. The following is shown.

DETAILED DESCRIPTION

Figure 1:
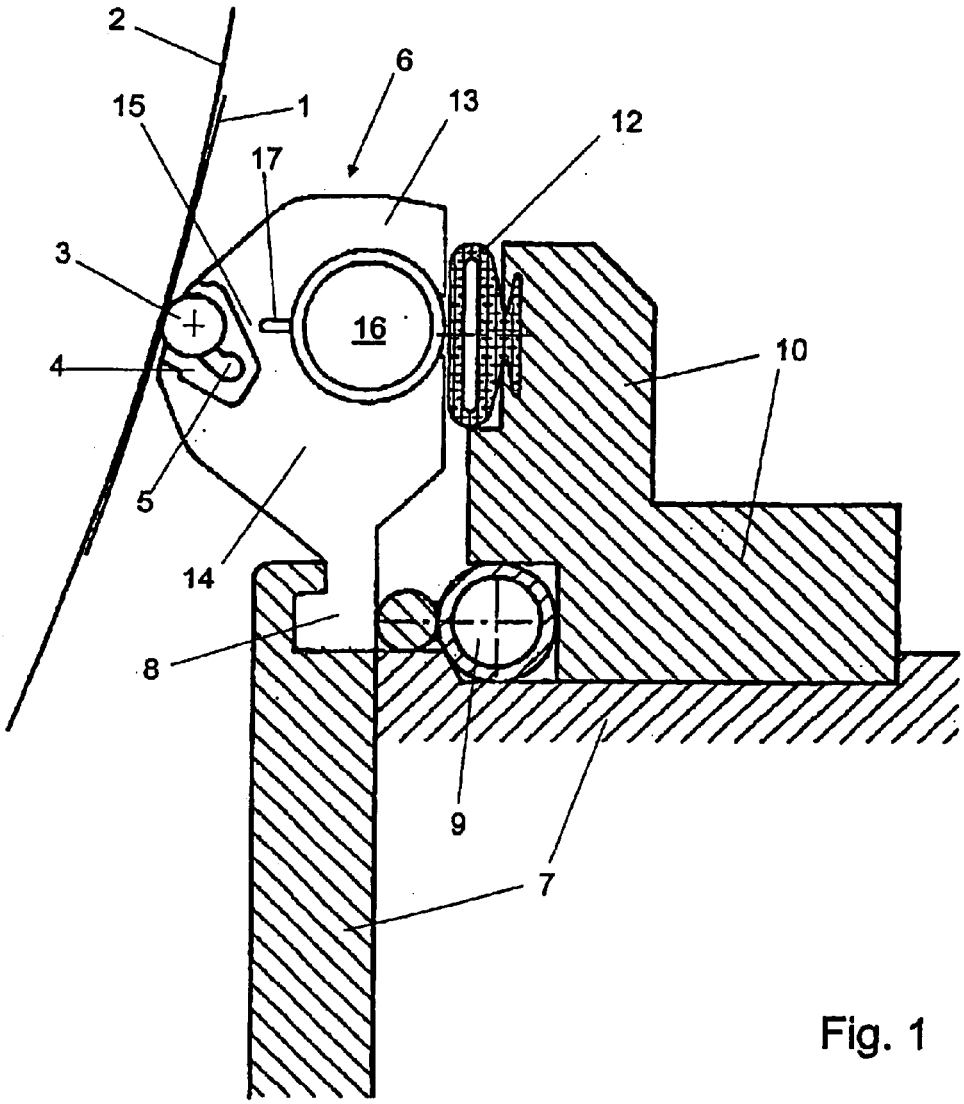
FIG. 1 - across section of an embodiment of a doctor blade dosing system according to the disclosure, FIG. 2 - a cross section of another embodiment, and FIG. 3 - the replacement of the doctor blade bed in the embodiment, according to FIG. 2.

The dosing system shown in the drawings is part of a device for coating a paper or paperboard web 1 with coating paint. It is preferably a so-called roll doctor system in which the web 1 is supported in the area of the dosing system by a mating roll 2. By the same token, the doctor blade dosing system can be used for indirect dosing, whereby a pre-dosed film of coating material is first applied onto a roll and subsequently transferred from this roll onto the web. Another application possibility is with so-called revolving doctor systems in which the web is transported over the doctor blade rod in a free section without being supported by a roll.

In the direction of rotation of the roll 2 upstream from the dosing system, there is a suitable application system (nozzle coater, kiss-roll coater, etc.) from which the coating paint is applied in an excess onto the web 1.

As the dosing element, the doctor blade dosing system includes a doctor blade rod 3 mounted so that a rotary drive can make it turn in a doctor blade bed 4 that is partially open towards the web 1. The lateral curved surface of the doctor blade rod 3 is either smooth or else provided with circumferential grooves. Its diameter preferably ranges from 6 mm to 25 mm. Preferred diameters are 9.75 mm, 10.00 mm, 12.00 mm, 12.7 mm, 13.65 mm, 15.00 rum, 15.87 mm and 16.00 mm. The axial length of the doctor blade rod 3 corresponds to the working width of the coating device, which can reach 10 meters. Preferably, the doctor blade rod is made of stainless steel and its lateral curved surface is coated so as to be wear-resistant, for example, chrome-plated or coated with a ceramic material.

The doctor blade bed 4 is preferably made of a material that is elastic, at least to a certain extent. According to an embodiment, it is made of an elastomer (rubber or plastic), preferably polyurethane. The hardness of the material of which the doctor blade bed 4 is made preferably ranges from 50 Shore A to 65 Shore D, preferably it lies between 85 Shore A and 95 Shore A. Thus,the material is relatively elastic so that the bed 4 can lie in contact with the doctor blade rod 3 so as to create a seal, in order to prevent the penetration of coating paint into the bed 4. The doctor blade bed 4 has a slot 18 into which the doctor blade rod 3 is inserted, whereby the doctor blade bed 4 encloses the doctor blade bed 4 at an angle range of at least 180° so that the doctor blade rod 3 is securely held in place.

As an alternative, it is also possible to make the doctor blade bed 4 out of polyethylene. The working to the required dimensional accuracy is then carried out with a cutting method, especially by milling.

The ratio of the cross-sectional area (measured in $mm^2$) of the doctor blade bed 4 to the diameter (measured in mm) of the doctor blade rod 3 is less than 60 mm, preferably less than 30 mm. Preferably, the ratio of the cross-sectional area of the doctor blade bed 4 to the diameter of the doctor blade rod 3 is 10 mm to 25 mm.

It has proven to be especially advantageous to have a doctor blade rod with a diameter $\leqq$16 mm that is inserted into a doctor blade bed 4 with a cross-sectional area of 100 $mm^2$ to 400 $mm^2$. The doctor blade bed 4 has a uniform cross section over the working width of the coating device, that is to say over the length of the doctor blade rod 3. At least one channel 5 that is open towards the doctor blade rod 3 is made in the doctor blade bed 4, and during the operation, water is fed into the channel to serve as a lubricant and cleanser.

Figure 3:
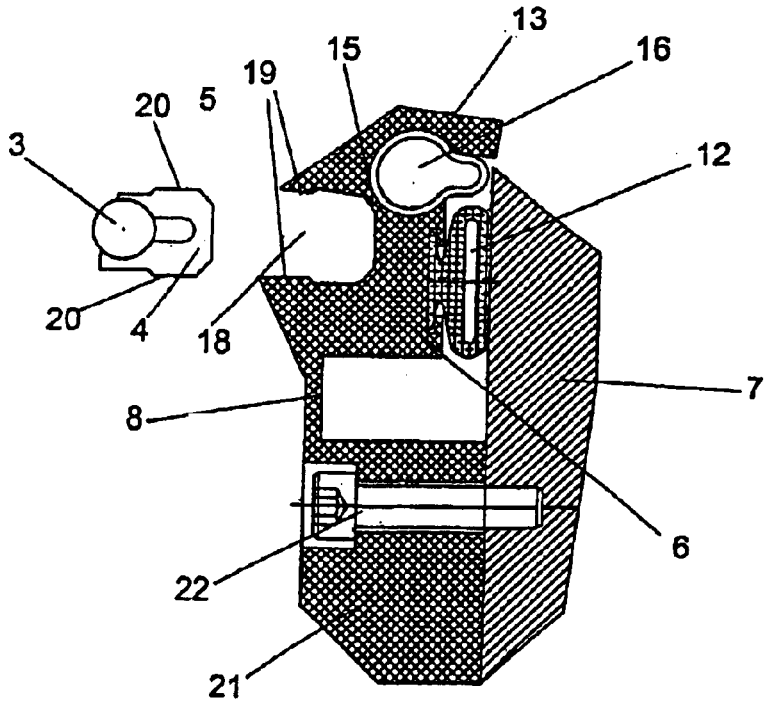

The doctor blade bed 4 is inserted in a removable manner into a slot 18 of a support 6 and said slot is open towards the web 1 as can be seen especially clearly in FIG. 3. The cross-sectional area of the slot 18 is adapted to the outer contour of the doctor blade bed 4 so that the latter is securely held in place by a positive or non-positive connection. Preferably, the opening of the slot 18 of the support 6 is limited by at least one projection 19, preferably by two projections 19, and the doctor blade bed 4 has a corresponding number (two in the embodiment) of matching widened sections 20 that are moved into the support 6 behind the projection or projections 19 when the doctor blade bed 4 is inserted, so that the doctor blade bed 4, after being inserted, is positively clamped in the support 6.

The support 6 is made of a plastic material, for example, polyethylene or polyurethane. The hardness of the material ranges from 50 Shore A to 65 Shore D. It is shaped like a clamp, having at least one rearward extending clamp limb 13 and one joint 15. The holding slot 18 that accommodates the doctor blade bed 4 forms the clamp jaw. On the back of the support 6, arranged on a clamp limb 13, there is a clamping tube 16 that presses the slot walls of the holding slot 18 toward one another and that can be filled with compressed air.

In the embodiment according to FIG. 1, the support 6 is configured with two rearward extending clamp limbs 13, 14. The clamping tube 16 is arranged between the two clamp limbs 13, 14.

Figure 2:
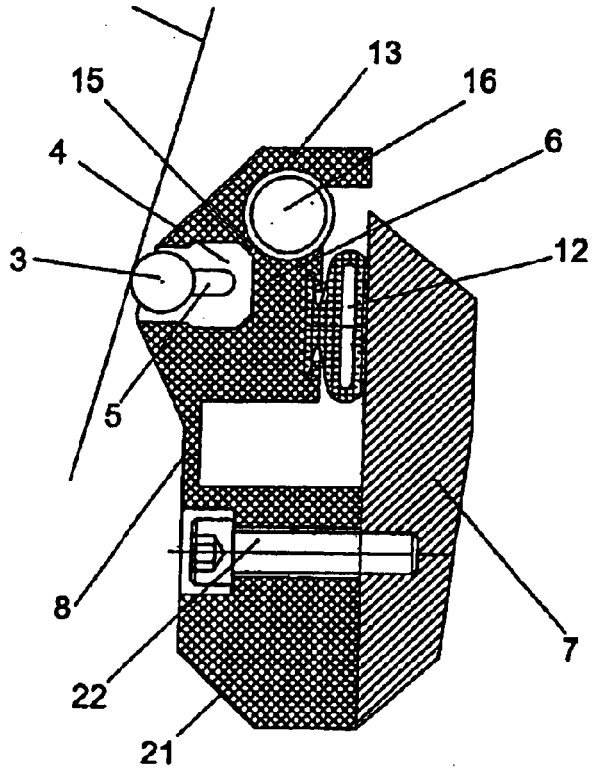

In the embodiment according to FIGS. 2 and 3, the support 6 has one clamp limb 13. The clamping tube 16 is mounted on the main part of the support 6 into which the slot 18 has been made. It presses the clamp limb 13 upwards in order to clamp the doctor blade bed 3 and consequently, it presses the upper slot wall of the holding slot 18 downwards.

Preferably, as a joint 15, an area of the support 6 between the clamping tube 16 and the holding slot 18 is configured as a weak spot with a reduced thickness. In the embodiment according to FIG. 1, for this purpose, a slit 17 is made into the support 6 extending from the area of the clamping tube 16 in the direction of the holding slot 18. In the embodiment according to FIGS. 2 and 3, the support 6 is configured so as to be correspondingly thin in the area between the holding slot 18 and the clamping tube 16. The thickness of the support 6, measured in the direction of the clamping tube 16 [–] (in FIG. 1 the distance between the slit 17 and the doctor blade bed 4) [–] is 0.5 mm to 10 mm, preferably 1 mm to 3 mm, at the weak spot. This ensures an adequate elasticity of the clamp limbs 13, 14.

The support 6 is detachably fastened to the foot 8 on a support beam 7 as part of the frame of the dosing system. In the embodiment according to FIG. 1, the support 6 is clamped tight with a rotating clamping element 9 that is arranged cross-wise over the working width of the coating device, extending in a slot that is open towards the foot 8 and that is in an angled bearing part 10 that is screwed onto the support beam 7. In the embodiment according to FIGS. 2 and 3, the foot 8 widens towards a fastening part 21 that is screwed onto the support beam 7 by means of screws 22.

On the back of the support 6, there is a pressure tube 12 that is supported on the frame of the system, that presses the support 6 in the direction of the doctor blade bed 4 and that extends crosswise over the length of said support 6. The pressure tube 12 is supported on the frame of the system and presses the back of the support 6 with the doctor blade bed 4 and the doctor blade rod 3 in the direction of the web 1 to be coated or of the roll, in order to build up the contact pressure of the doctor blade rod 4 against the web 1 or against the roll. In order to make this possible, an area of the foot 8 of the support 6 is made so as to be elastic, at least to a certain extent. In the embodiments, the elasticity is effectuated by a thinner cross section between the fastening place on the bearing part 10 and the main part with the holding slot 18.

In the embodiment according to FIG. 1, the pressure tube 12 is fastened at the top on the vertical part of the bearing part 10, while in the embodiment according to FIGS. 2 and 3, it is on the back of the support 6.

During an operational standstill, the doctor blade bed 4 with the inserted doctor blade rod 3 is placed into the slot 18 of the support 6 while the clamping tube 16 is without pressure. As is shown in FIG. 3, the clamp limb 13 is pre-tensioned in such a way that the slot 18 autonomously opens somewhat, without pressure in the clamping tube 16. After insertion of the doctor blade bed 4, compressed air is fed into the clamping tube 16. As a result, the slot walls of the support 6 are pressed against each other and the doctor blade bed 4 with the doctor blade rod 3 is affixed in the support 6. The pressure is selected here in such a way that, on the one hand, the bed 4 and the rod 3 are securely held in place and, on the other hand, the friction of the doctor blade rod 3 is sufficiently low. If vibrations occur during operation, the pressure is varied for damping purposes.

What is claimed is:

1. A doctor blade dosing system, comprising:

(a) a frame;

(b) a plastic, clamp-shaped support that can be fastened in said frame, said support defining a holding slot having walls defining a jaw, said support defining at least one rearwardly extending clamp limb and one joint;

(c) a doctor blade bed having a cross-sectional area and mounted in the holding slot on the support, said doctor blade bed defining a doctor blade slot;

(d) a doctor blade rod having a diameter of less than 25 mm held in the slot of the doctor blade bed; and, (e) a clamping tube disposed on a clamp limb and pressing the holding slot walls toward one another, the ratio of the cross-sectional area ($mm^2$) of the doctor blade bed to the diameter (mm) of the doctor blade rod being less than 60 mm.

2. The doctor blade dosing system according to claim 1, comprising a pressure tube on the back of the support supported on the frame that presses the support toward the doctor blade bed.

3. The doctor blade dosing system according to claim 1, wherein said ratio is 10 mm to 25 mm.

4. The doctor blade dosing system according to claim 1, wherein the diameter of the doctor blade rod is ≦16 mm and the cross-sectional area of the doctor blade bed is 100 $mm^2$ to 400 $mm^2$.

5. The doctor blade dosing system according to claim 1, wherein the opening of the slot of the support is limited by at least one projection, and the doctor blade bed has a corresponding number of widened sections that engage the support behind the projection when the doctor blade bed is inserted.

6. Doctor blade dosing system according to claim 5, wherein the doctor blade bed defines one projection.

7. Doctor blade dosing system according to claim 5, wherein the doctor blade bed defines two projections.

8. The doctor blade dosing system according to claim 1, wherein the doctor blade bed encloses an inserted doctor blade rod by at least 180°.

9. The doctor blade dosing system according to claim 1, wherein at least one of the doctor blade bed and the support is made of an elastomer.

10. Doctor blade dosing system of claim 9, wherein said elastomer has a hardness ranging from 50 Shore A to 65 Shore D.

11. Doctor blade doing system of claim 9, wherein said elastomer is polyurethane.

12. Doctor blade dosing system of claim 11, wherein said elastomer has a hardness ranging from 50 Shore A to 65 Shore D.

13. The doctor blade dosing system according to claim 1, wherein at least one of the doctor blade bed and the support is made of polyethylene that was worked with a cutting method.

14. The doctor blade dosing system according to claim 1, wherein the doctor blade bed is made of an elastic material.

15. The doctor blade dosing system according to claim 1, wherein said joint is defined by an area of the support between the clamping tube and the holding slot is configured as a weak spot with a reduced thickness.

16. The doctor blade dosing system according to claim 15, wherein the thickness of the support measured radially to the doctor blade bed in the direction of the clamping tube is 0.5 mm to 10 mm.

17. Doctor blade dosing system of claim 16, wherein said thickness is 1 mm to 3 mm.

18. Doctor blade dosing system according to claim 1, wherein said ratio is less than 30 mm.

* * * * *